US007491663B2

(12) United States Patent
Perillon et al.

(10) Patent No.: US 7,491,663 B2
(45) Date of Patent: Feb. 17, 2009

(54) DISPLAY SUPPORT COMPRISING A COATED FABRIC

(75) Inventors: Jean-Luc Perillon, Saint Paul Trois Chateaux (FR); Michael Langner, Erzingen (DE)

(73) Assignee: Tissage et Enduction Serge Ferarisa, Saint Jean de Soudain (FR)

( * ) Notice: Subject to any disclaimer, the term of this patent is extended or adjusted under 35 U.S.C. 154(b) by 185 days.

(21) Appl. No.: 10/808,133

(22) Filed: Mar. 24, 2004

(65) Prior Publication Data

US 2004/0180593 A1 Sep. 16, 2004

Related U.S. Application Data

(63) Continuation of application No. PCT/FR02/03288, filed on Sep. 26, 2002.

(30) Foreign Application Priority Data

Sep. 27, 2001 (FR) ..... 01 12433

(51) Int. Cl.

| | |
|---|---|
| ***B32B 27/12*** | (2006.01) |
| ***B32B 27/04*** | (2006.01) |
| ***B32B 5/16*** | (2006.01) |
| ***B32B 27/14*** | (2006.01) |

(52) U.S. Cl. ..... 442/64; 442/65; 442/66; 442/67; 442/68; 442/70; 442/74; 442/131; 442/132; 442/133

(58) Field of Classification Search ..... 442/64, 442/65, 66, 67, 68, 70, 74, 131, 132, 133; 428/41.8, 352

See application file for complete search history.

(56) References Cited

U.S. PATENT DOCUMENTS

| | | | | |
|---|---|---|---|---|
| 1,784,810 | A * | 12/1930 | Bonney et al. | 442/68 |
| 3,770,559 | A | 11/1973 | Jackson | 161/89 |
| 4,318,953 | A * | 3/1982 | Smith et al. | 428/200 |
| 5,030,498 | A | 7/1991 | Okada et al. | |
| 5,229,207 | A * | 7/1993 | Paquette et al. | 428/355 AC |
| 5,707,904 | A * | 1/1998 | Gray et al. | 442/46 |
| 5,895,705 | A * | 4/1999 | Crouch et al. | 156/247 |
| 6,037,280 | A * | 3/2000 | Edwards et al. | 442/131 |

FOREIGN PATENT DOCUMENTS

| | | |
|---|---|---|
| DE | 20109382 U | 10/2001 |
| EP | 0480199 A2 | 4/1992 |
| FR | 1519760 | 4/1968 |
| JP | 2297481 | 12/1990 |

* cited by examiner

*Primary Examiner*—Ula C Ruddock
(74) *Attorney, Agent, or Firm*—Heslin Rothenberg Farley & Mesiti P.C.; Victor A. Cardona, Esq.

(57) ABSTRACT

A display support, designed to be printed, includes a coated fabric comprising a textile layer and two impregnation layers located on opposite surfaces of the textile layer. A coat of varnish, designed to be printed, is deposited on one of the impregnation layers. A pressure-sensitive adhesive layer capable of being repositioned, is deposited on the impregnation layer opposite the one receiving the coat of varnish. A protective layer arranged on the adhesive layer consists of a sheet with low adherence strength relative to the pressure-sensitive adhesive layer.

16 Claims, 1 Drawing Sheet

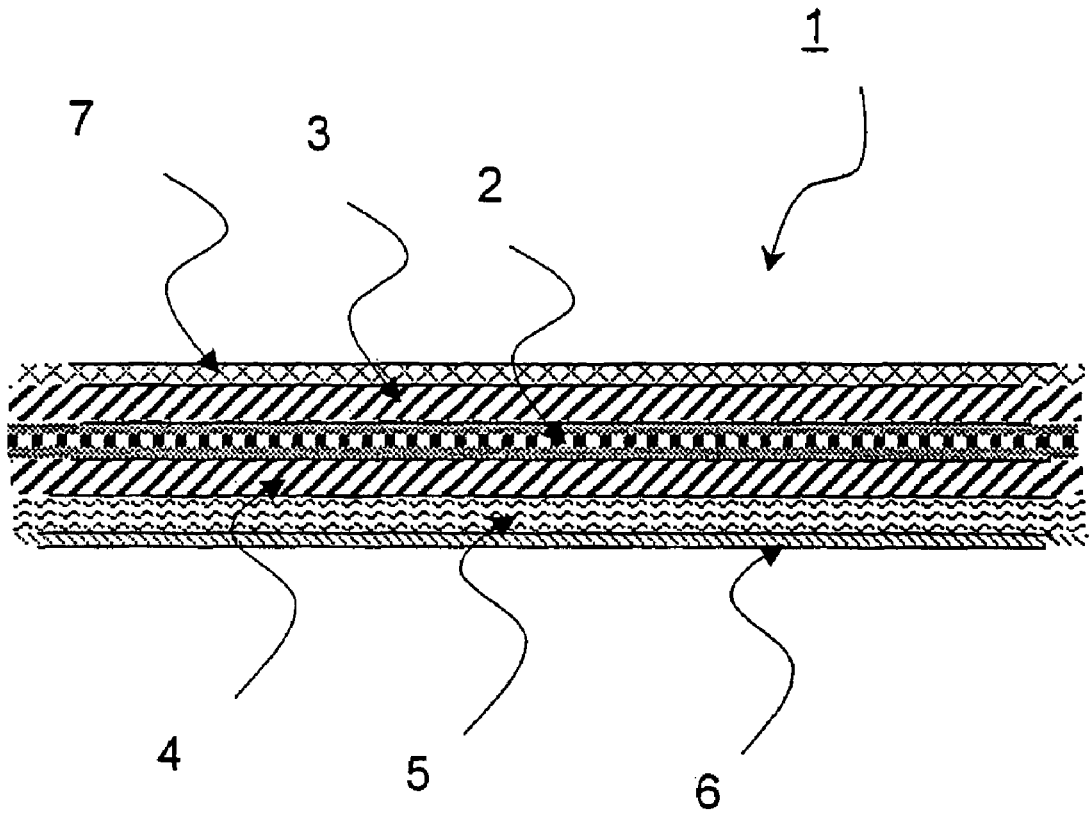
1
7
3
2
4
5
6

DISPLAY SUPPORT COMPRISING A COATED FABRIC

CROSS-REFERENCE TO RELATED APPLICATIONS

This application is a continuation of international application PCT/FR02/03288 filed Sep. 26, 2002 and published as WO 03/035968 on May 1, 2003, in French, and claims priority from French application number 01.12433 filed Sep. 27, 2001, the contents of which applications are incorporated by reference, in their entirety, herein.

TECHNICAL FIELD

The invention relates to the field of the textile industry and, more particularly, of impregnated or coated fabrics. It is concerned, more particularly, with a novel coated fabric structure which allows it to be used in various applications, especially as a display support or as a protective screen against solar radiation.

PRIOR ART

In general terms, a coated fabric comprises a textile core, onto which an impregnation layer is deposited on one or other of the faces or on both. This impregnation layer is generally produced from a polymeric material, typically polyvinyl chloride, with which plasticizing agents are combined. The combination of this textile core and of the impregnation layers gives the coated fabric some advantageous properties, especially some mechanical resistance, and also good stability with respect to ultraviolet radiation, thus allowing it to be used outside, for example as a blind or cladding or in other architectural applications, and also as truck sheeting.

Among other applications, the possibility of using coated fabrics as a display support may be mentioned. In this case, the fabric is printed by means of a known method, and it is placed onto a frame so as to preserve a plane geometry. Devices allowing the display to be maintained under tension with respect to the frame make it possible to obtain a high-quality display support.

The use of a rigid frame is nevertheless a cause of disadvantages. To be precise, such a frame has a relatively high weight, all the more so because the display has large dimensions. It is therefore necessary to ensure that this frame is lashed down, especially when it is arranged outside and undergoes wind forces.

Furthermore, the dimensions of such a frame necessitate the use of a display support which has the same dimensions, and this may prove to have an adverse cost effect. Moreover, the cost of a rigid frame results in an increase in the cost price of the display system, which may prove prohibitive.

The object of the invention is, therefore, to provide a display device which possesses the qualities of display supports made from coated fabric and the implementation of which makes it possible to dispense with a rigid frame.

Display support is understood to mean not only applications as an advertising or decorative display, but also applications as an indicator element.

A secondary application of the display support relates to protection against solar radiation, which generally makes use of coated fabrics. These fabrics are used as blinds or cladding and are placed in front of a building, on the inside of a rigid frame in which the fabric is tensioned. Putting the rigid frame for solar protection screens in place has the disadvantages identified with regard to an advertising display, to be precise the disadvantages associated with the weight and cost of a rigid frame.

Another object of the invention is to make it possible to produce screens for protection against solar radiation from a coated fabric, where these various disadvantages are eliminated.

PRESENTATION OF THE INVENTION

The invention therefore relates to a display support capable of being printed.

According to the invention, this display support is characterized in that it likewise comprises:

- a coated fabric comprising a textile layer and two impregnation layers, each arranged on one face of is the textile layer;
- a varnish layer capable of being printed and deposited onto one of the impregnation layers;
- a repositionable pressure-sensitive adhesive layer deposited onto the impregnation layer opposite that receiving the varnish layer;
- a protective layer arranged on the adhesive layer and formed from a sheet possessing very low adhesive force with respect to the pressure-sensitive adhesive layer.

In other words, the invention involves equipping a face of the coated fabric with an adhesive which makes it possible to position the display support on widely varying display zones. This adhesive is selected so as to enable the user to detach the display support from the display zone, so as to reposition it as many times as is necessary. Thus, the display support can be used several times in succession, thus making it possible to justify the cost of some display campaigns or else to carry out the repositioning operations very easily when they are necessary.

Owing to the choice of these pressure-sensitive adhesives, the fabric does not leave a mark on the display zone when it is removed from the latter.

On the face opposite the adhesive, the coated fabric comprises a varnish, lacquer or similar layer which imparts some particular properties to that layer of the fabric which can be seen when the latter is bonded to the display zone. The characteristic varnish layer has the capability of being printed according to inkjet, screenprinting or such like techniques.

The protective layer located on the adhesive layer both makes it possible to protect the adhesive when the display support is wound on itself and also allows passage through printing machines.

To be precise, in some printing machines, the printed support is subjected to a rise in temperature which could cause a modification of the properties of the adhesive layer, the inadvertent creep of the latter and its transfer to the machine itself. Moreover, the paper makes it possible to protect the machine with respect to the ink, where open-worked fabrics are concerned.

Advantageously, in practice, the textile layer may be a solid or open-worked fabric or else a mesh. This textile layer may be produced from various threads, in particular based on polyester, polyamide or glass fibers.

In practice, at least one of the impregnation layers can be produced, based on polyvinyl chloride which incorporates plasticizing agents.

In this case, the pressure-sensitive adhesive layer has a very low porosity with respect to the plasticizers present in the adjacent impregnation layer. Very low porosity is understood to mean that migration phenomena between the impregnation layer and the adhesive are extremely limited. To be precise, the plasticizers which would tend to migrate would cause a modification in the mechanical properties of the adhesive and a deterioration in the adhesive power of the display support, along with a risk of inhomogeneity.

Advantageously, in practice, the pressure-sensitive adhesive layer possesses an adhesive force of between 1 and 100 Newton, for a strip with a width of 5 cm.

When the adhesive force is lowest, typically between 1 and 30 Newton per 5 cm of width, the fabric is then detachable very easily. It is then used for applications in which it has to be repositioned very frequently. Conversely, for adhesive forces greater than 50 Newton for a width of 5 cm, the supports adhere more firmly to the display zones and are therefore intended for more durable display or positioning.

In the application for solar protection coverings, either the varnish layer or at least one of the impregnation layers or else the ink used for printing the face receiving the varnish has reflecting properties. These may, for example, be layers which include metallic particles, in particular aluminum particles.

Depending on whether the display support is placed outside or inside, preference will be given to imparting reflecting properties to the layer located furthest on the outside. In other words, if the fabric is arranged on the inner face of a glazed surface, the impregnation layer which is in contact with the adhesive will be reflecting. Conversely, if the fabric is arranged outside the glazed surface, the varnish layer and/or the adjacent impregnation layer will be reflecting.

As already mentioned, this display support makes it possible to position these displays very quickly on a plane zone. Such a display can be displaced very quickly or else be detached from the display zone very quickly, so that it can be used once again elsewhere.

Such a display support may also use as textile core a fabric possessing particular properties, for example that of being electrically conductive. In the latter case, the fabric placed on its support can then be used as a heat source, for example, as a partition lining.

BRIEF DESCRIPTION OF THE FIGURES

How the invention is implemented and the advantages which arise from it may be gathered clearly from the description of the following particular embodiment, with reference to the single accompanying FIGURE which illustrates a diagrammatic sectional view of a display support according to the invention.

IMPLEMENTATION OF THE INVENTION

As set out above, the invention relates to a coated fabric which possesses a layer of pressure-sensitive adhesive material, allowing it to be capable of being placed very easily on any plane zone, especially vertical.

The invention is therefore produced from a coated fabric, itself formed from a first textile layer (2), onto which two impregnation layers (3, 4) are deposited on each face. More specifically, the textile layer (2) may be produced either from a mesh or from a fabric. This fabric may be open-worked, that is to say have apertures between its various warp and weft threads, or else be solid, that is to say have contiguous warp and weft threads.

In practice, the textile core may be produced from threads of a linear density of between 50 and 1110 decitex, or even more. These may be polyester threads, the mechanical resistance of which proves to be advantageous. However, the use of polyamide or of glass fibers also makes it possible to obtain satisfactory results. After weaving or after mesh formation, the textile core possesses a mass per unit area of the order of 40 to 300 grams per square meter.

This textile core (2) receives an impregnation layer (3, 4) on each of its faces. This impregnation layer may advantageously be produced from polyvinyl chloride (PVC). This PVC possesses a K-value index of between 50 and 80.

These coating layers (3, 4) also comprise plasticizing agents which are incorporated with the PVC. These plasticizing agents may be of the phthalate or phosphate type or else be other plasticizers possessing a low migration capacity within the PVC. Thus, for 100 parts of PVC, between 40 and 120 parts of plasticizer will be added.

The impregnation layers (3, 4) also comprise conventional stabilizing agents present in from 2 to 100 parts per 100 parts of PVC. These stabilizers are useful for absorbing some of the energy which the coating layer receives during its manufacture or as a result of exposure to ultraviolet rays. These agents therefore ensure protection against the radiation of the coating layer, at the same time prevent its deterioration.

The impregnation layers (3, 4) may also include fillers intended for increasing the rate of the layer or for giving it particular properties. Thus, such a filler may be calcium carbonate ($CaCO_3$), or they may also be flame-retarding fillers, typically aluminum trihydroxide ($Al(OH)_3$) or antimony oxide ($Sb_2O_3$). These fillers may be present up to 80 parts per 100 parts PVC.

In total, the weight of each impregnation layer (3, 4) is typically lower than 300 grams per square meter.

On one of the impregnation layers (3), the fabric according to the invention possesses a varnish layer (7). This surface layer is produced, based on a varnish containing acrylic, vinyl or cellulose polymers. This layer is deposited in a mass of 2 to 80 grams per square meter. The varnish is selected for its good printing capacities, either with aqueous inks or with solvent-based inks or printer's inks or else inks cross-linking under ultraviolet rays. Where screen-printing is concerned, the selected varnish is compatible with this printing method.

If the display support is also used as a solar radiation screen, the upper varnish layer may in some cases incorporate metallic particles, so as to be reflecting.

The impregnation layer (4) receives a layer of adhesive material which is selfadhesive and is pressure-sensitive. More specifically, the adhesive used is typically based on acrylic or methacrylate polymers or derivatives. If the adhesive layer (5) is placed onto an impregnation layer (4) including plasticizers, the selected material possesses good resistance to the migration of these plasticizers. This migration resistance can be assessed by evaluating the change in the adhesion properties. Thus, with the fabric being kept in an oven of 40° C. for five weeks, no substantial modification in the adhesion properties must be observed.

To be precise, when the migration phenomena causing the plasticizers to pass from the coating layer (4) towards the adhesive layer (5) are too great, this indicates a deterioration in the adhesive which in places loses some of its adhesive properties. In this case, there is the risk that, when the fabric is peeled off, part of the adhesive layer (5) is detached from the impregnation layer (4) and remains on the wall or, more generally, on the display zone which received it.

The quantity of adhesive deposited is of the order of 20 to 100 grams per square meter, corresponding to a thickness of the order of 20 to 100 microns.

As already mentioned, the adhesive force of the adhesive on the display zone may vary, depending on the type of application desired. Thus, for an application on a relatively porous support of the concrete or plaster type, it will be necessary to deposit a layer of adhesive which is relatively thick, but in any event thicker than for an application on a smoother support.

As regards the adhesive force, this may be between 1 and 30 Newton for a strip with a width of 5 cm, for frequently repositionable applications. An additional extraction force amounting to 100 Newton for a strip of 5 cm will be preferred for applications in which adhesion is more durable. The adhesive force is measured by means of a dynamometer in the configuration where the peel-off portion is substantially perpendicular to the display zone.

As illustrated in the FIGURE, the layer of adhesive material (5) is protected by a protective layer (6) which is produced from a sheet typically of silicone paper or else from a polyethylene film. This protective sheet (6) has very low adhesion with respect to the layer (5) and can be removed very easily, without taking off any adhesive during this operation. This protective sheet makes it possible to avoid contact between the adhesive layer (5, 6) and the printed varnish layer (7) when the fabric (1) is wound on itself. This prevents pigments of the printing ink from passing into the adhesive layer, which would impair the visual appearance of the printed face and could also modify the properties of the adhesive layer.

The presence of the protective paper where meshes are concerned makes it possible to protect the printing machine against splashes of ink during the printing step. The presence of the protective paper thus reduces the maintenance operations on the machine, while at the same time allowing it to operate over a wider range of supports.

Furthermore, during the printing operations, it may be that the display support is subjected to heat sources, and it is important that the adhesive layer, which tends to soften when it is exposed to heat, does not begin to stick to the printing table on which it rests.

It may be gathered from the foregoing that the display support according to the invention has many advantages, especially that of being capable of being placed onto virtually any display zone, without the need to use a rigid frame. The use of polymeric impregnation layers incorporating the flame-retarding fillers affords an advantage to this type of display, as compared with a paper support.

Owing to the absence of a holding frame, this display support can be cut to the desired shapes, without any geometric limitation.

This advantage likewise proves especially advantageous when the support is used as a protective screen against solar radiation. To be precise, it can thus be cut to the dimensions of the filtered surfaces onto which it is placed.

INDUSTRIAL APPLICATIONS

The coated fabric according to the invention can be used in a large number of applications, in particular:

advertising display, indicator signs, the cladding of facades or of partitions, along with, in a particular variant, the possibility of making the fabric conductive and therefore allowing it to radiate heat energy, protective covering against solar radiation, motor vehicles or dwellings.

The invention claimed is:

1. A printable display support, comprising:

a coated fabric comprising a textile layer and two impregnation layers, one of said impregnation layers located on one face of the textile layer, another of said impregnation layers located on an opposite face of the textile layer;

a printable varnish layer deposited onto the one of the impregnation layers;

a repositionable pressure-sensitive adhesive layer deposited onto the other impregnation layer, said adhesive layer remaining continuously repositionable; and a protective layer arranged on the adhesive layer and formed from a sheet possessing very low adhesive force with respect to the pressure-sensitive adhesive layer.

2. A display support as claimed in claim 1, wherein the textile layer is a fabric or a mesh.

3. The display support as claimed in claim 1, wherein the textile layer is based on polyester, polyamide or glass fibers.

4. The display support as claimed in claim 1, wherein at least one of the impregnation layers is produced, based on polyvinyl chloride, and contains plasticizing agents.

5. The display support as claimed in claim 4, wherein the pressure-sensitive adhesive layer has a very low porosity with respect to plasticizer present in the other impregnation layer.

6. The display support as claimed in claim 1, wherein the pressure-sensitive adhesive layer possesses an adhesive force between 1 and 100 Newton, for a strip with a width of 5 cm.

7. The display support as claimed in claim 1, wherein at least one of the impregnation layers or the varnish layer has properties reflecting solar radiation.

8. The display support as claimed in claim 7, wherein at least one of the impregnation layers or the varnish layer includes metallic particles.

9. The display support of claim 1 wherein said varnish layer comprises means for receiving a printing layer on said varnish layer and said printing layer being separate from said varnish layer.

10. The display support of claim 1 wherein the repositionable pressure sensitive adhesive layer is repositionable relative to a display zone as often as desired by a user.

11. A display, comprising:

a coated fabric comprising a textile layer and two impregnation layers, one of said impregnation layers located on one face of the textile layer, another of said impregnation layers located on an opposite face of the textile layer;

a printable varnish layer deposited onto the one of the impregnation layers;

a continuously repositionable pressure-sensitive adhesive layer deposited onto the other impregnation layer;

a protective layer arranged on the adhesive layer and formed from a sheet possessing very low adhesive force with respect to the pressure-sensitive adhesive layer; and an ink layer separate from said varnish layer, said ink layer deposited on said varnish layer to provide printing to said varnish layer.

12. The display of claim 11 wherein said varnish layer comprises means for receiving a printing layer on said varnish layer and said printing layer being separate from said varnish layer.

13. The display of claim 11 wherein the repositionable pressure sensitive adhesive layer is repositionable relative to a display zone as often as desired by a user.

14. A display support capable of being printed, comprising:

a coated fabric comprising a textile layer and two impregnation layers, one of said impregnation layers located on one face of the textile layer, another of said impregnation layers located on an opposite face of the textile layer;

a printable varnish layer capable of being printed and deposited onto the one of the impregnation layers;

a repositionable pressure-sensitive adhesive layer deposited onto the other impregnation layer, the adhesive layer remaining continuously repositionable and possessing an adhesive force between 1 and 100 Newtons for a strip with a width of about 5 cm; and a protective layer arranged on the adhesive layer and formed from a sheet possessing very low adhesive force with respect to the pressure-sensitive adhesive layer.

15. The display support of claim 14 wherein said varnish layer comprises means for receiving a printing layer on said varnish layer and said printing layer being separate from said varnish layer.

16. The display support of claim 14 wherein the repositionable pressure sensitive adhesive layer is repositionable relative to a display zone as often as desired by a user.

* * * * *

UNITED STATES PATENT AND TRADEMARK OFFICE

CERTIFICATE OF CORRECTION

PATENT NO. : 7,491,663 B2
APPLICATION NO. : 10/808133
DATED : February 17, 2009
INVENTOR(S) : Perillon et al.

It is certified that error appears in the above-identified patent and that said Letters Patent is hereby corrected as shown below:

On the Title Page:

item (73): Delete "Tissage et Enduction Serge Ferarisa" and insert -- Tissage et Enduction Serge Ferari Sa --

Signed and Sealed this

Second Day of June, 2009

JOHN DOLL
*Acting Director of the United States Patent and Trademark Office*